US007828581B2

(12) United States Patent
Okayasu

(10) Patent No.: US 7,828,581 B2
(45) Date of Patent: Nov. 9, 2010

(54) ELECTRICAL CONNECTOR WITH A RETAINER PRESSING THE WIRE CONNECTING PORTION OF A WIRE TERMINAL

(75) Inventor: Yasushi Okayasu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/510,564

(22) Filed: Jul. 28, 2009

(65) Prior Publication Data

US 2010/0048054 A1 Feb. 25, 2010

(30) Foreign Application Priority Data

Aug. 20, 2008 (JP) ..... 2008-212276

(51) Int. Cl.
*H01R 13/627* (2006.01)

(52) U.S. Cl. ..... 439/352

(58) Field of Classification Search ..... 439/752, 439/352, 595
See application file for complete search history.

(56) References Cited

U.S. PATENT DOCUMENTS 6,568,948 B2 * 5/2003 Matsuoka ..... 439/271
6,575,788 B2 * 6/2003 Nimura et al. ..... 439/595
6,929,499 B2 * 8/2005 Nakamura ..... 439/352
7,195,522 B2 * 3/2007 Okada et al. ..... 439/752
7,527,514 B2 * 5/2009 Tsuji ..... 439/352
2002/0076995 A1 * 6/2002 Kurimoto et al. ..... 439/752
2003/0008557 A1 1/2003 Suzuki
2007/0093131 A1 4/2007 Takahashi et al.
2008/0009171 A1 * 1/2008 Tsuji ..... 439/352
2008/0293300 A1 * 11/2008 Katsuma ..... 439/595

FOREIGN PATENT DOCUMENTS

JP 5226025 9/1993
JP 2005222815 8/2005

* cited by examiner

*Primary Examiner*—Chandrika Prasad
(74) *Attorney, Agent, or Firm*—Gerald E. Hespos; Michael J. Porco

(57) ABSTRACT

A terminal fitting (20) includes a terminal connecting portion (21) in a front end region and a wire barrel (25) behind the terminal connecting portion (21). The terminal fitting (20) is inserted into a cavity (11) of a housing (10) from behind. Wires (40) are crimp-connected with the wire barrels (25) and are drawn out backward from the housing (10). A retainer (30) is mounted in the housing (10) and engages the terminal connecting portions (21) from behind for preventing backward displacements of the terminal fittings (20). The retainer (30) includes resilient pressing portions (32) that can resiliently press the wire barrels (25) in a direction intersecting with a draw-out direction of the wire (40) from the housing (10).

16 Claims, 2 Drawing Sheets

ELECTRICAL CONNECTOR WITH A RETAINER PRESSING THE WIRE CONNECTING PORTION OF A WIRE TERMINAL

BACKGROUND OF THE INVENTION

1. Field of the Invention

The invention relates to a connector.

2. Description of the Related Art

Japanese Unexamined Patent Publication No. 2005-222815 discloses a connector constructed by inserting a terminal fitting into a housing. A wire barrel is formed at a rear part of the terminal fitting and can be crimped into electrical connection with an exposed conductor of a wire. The wire connected with the terminal fitting is drawn out of the housing.

Copper generally is used as a conductor in a wire and has a relatively low rigidity. A material having a rigidity higher than copper (e.g. aluminum) can be used as a conductor. Additionally, a material having a lower electrical conductivity than copper (e.g. aluminum) can be used as a conductor in a wire, but may require a thicker and more rigid core. The wire drawn out backward from the housing may be subjected to an external force acting in a direction intersecting with a draw-out direction from the housing. This force may incline the terminal fitting in the housing due to the rigidity of the wire. Hence, a contact state with a mating terminal may become unstable to reduce contact reliability.

The invention was developed in view of the above situation and an object thereof is to prevent a terminal fitting from being inclined in a housing when a wire is subjected to an external force acting in a direction intersecting with a draw-out direction from the housing.

SUMMARY OF THE INVENTION

The invention relates to a connector with a housing formed with at least one cavity. The connector also includes at least one terminal fitting that has opposite front and rear ends. A terminal connecting portion is formed at the front end and functions as connection means for connecting with a mating terminal. At least one wire connection portion is formed behind the terminal connecting portion and is insertable into the cavity in an inserting direction. The wire connecting portion is electrically connectable to a conductor of wire having a conductor. The wire then can be drawn out of the housing in a draw-out direction. The connector also includes a retainer that engages the terminal connecting portion from a withdrawal side for preventing a displacement of the terminal fitting out of the housing. The retainer has at least one resilient pressing portion for resiliently pressing the wire connection portion in a direction intersecting with the draw-out direction of the wire from the housing.

The wire connection portion is sandwiched resiliently between the retainer and the inner wall of the cavity by the resilient pressing portion of the retainer. Accordingly, the pressing force of the resilient pressing portion prevents a posture change of the terminal fitting even if an external force acts on the wire in a direction intersecting the draw-out direction from the housing. A dimension of the wire connection portion may vary in a pressing direction of the resilient pressing portion due to dimensional tolerances of the production and/or springback of the wire barrel portion after a crimping operation. However, the resilient pressing portion resiliently presses the wire connecting portion. Thus, a variation in the dimension of the wire connection portion is absorbed so that the pressing force can be given reliably to the wire connection portion.

The wire connection portion preferably comprises at least one wire barrel to be crimp-connected with the conductor of the wire.

The wire preferably has a conductor surrounded by an insulation coating. The conductor is exposed by removing the insulation coating from an end portion of the wire. The exposed part of the conductor then is crimp-connected with the wire barrel. The terminal fitting then is inserted into the cavity so that the wire is drawn out backward from the housing.

The resilient pressing portion preferably extends substantially parallel to a length direction of the wire and has the front and rear ends supported on the retainer. Thus, the resilient pressing portion has can exhibit a strong resilient pressing force.

The resilient pressing portion preferably presses at least the front and rear ends of the wire connection portion for reliably preventing a posture change of the terminal fitting.

A longitudinal extension of the resilient pressing portion preferably is set so that a distance between pressing positions of the resilient pressing portion on the wire barrel is substantially equal to the entire length of the wire barrel to define a maximum pressing range for the wire barrel in forward and backward directions.

A formation region of the resilient pressing portion in forward and backward directions preferably extends from a position before the front end of the wire barrel to a position behind the rear end of the wire barrel.

At least one large-diameter portion preferably is formed at the front and/or rear ends of the wire barrel.

A locking lance preferably is provided in or adjacent the cavity for holding the properly inserted terminal fitting in the cavity.

A mount space preferably is formed in the housing and opens in a lateral surface of the housing substantially opposite to the wall where the locking lance is provided. The retainer preferably is mountable into the mount space to engage the terminal fitting.

The housing preferably comprises a plurality of cavities for a corresponding plurality of terminal fittings. The retainer preferably comprises a plurality of resilient pressing portions individually corresponding to each cavity where a terminal fitting is to be arranged.

These and other features of the invention will become more apparent upon reading of the following detailed description of preferred embodiments and accompanying drawings.

DETAILED DESCRIPTION OF THE PREFERRED EMBODIMENTS

Figure 1:
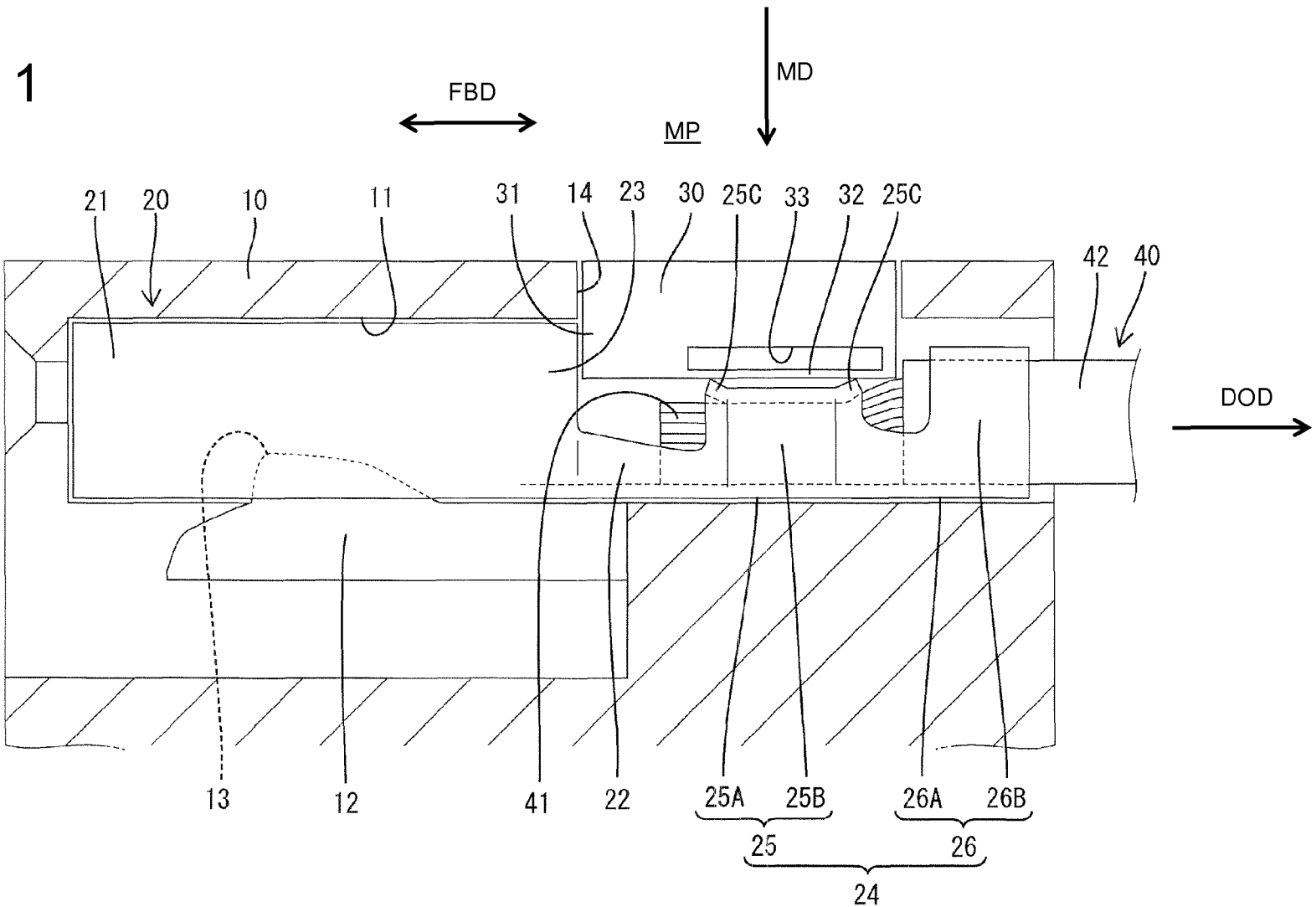
FIG. 1 is a section showing a state where a retainer is held at a full locking position in one embodiment.
Figure 2:
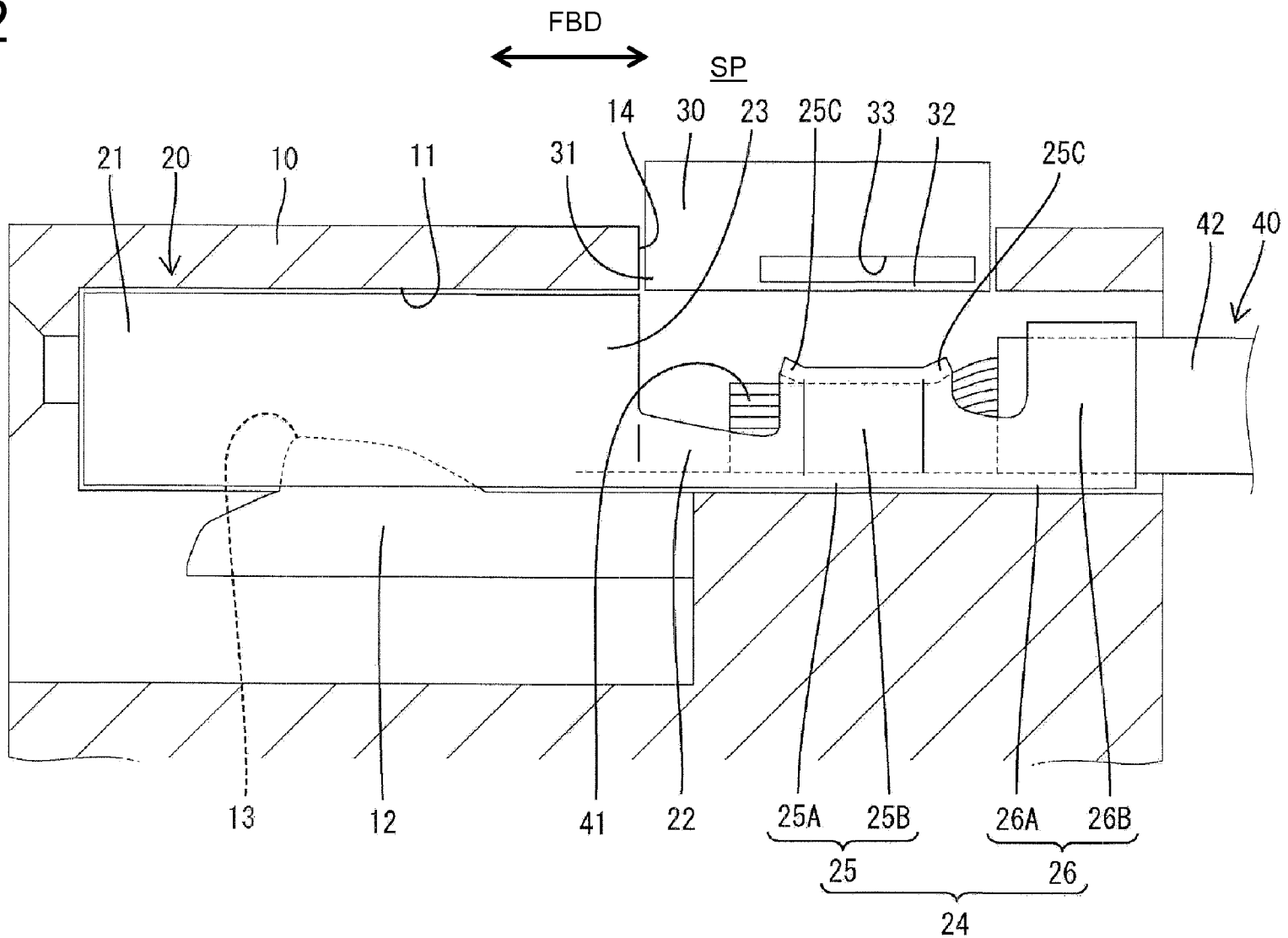
FIG. 2 is a section showing a state where the retainer is held at a partial locking position.

A connector in accordance with the invention includes a housing 10, terminal fittings 20, a retainer 30 and wires 40 as illustrated in FIGS. 1 and 2. Each wire 40 has a conductor 41 surrounded by an insulation coating 42. The insulation coating 42 is removed adjacent a front end portion of the wire 40 to expose the conductor 41 prior to connection with the terminal fitting 20. Copper, a material having a higher rigidity than copper (e.g. aluminum or an aluminum alloy) or a material having a lower electrical conductivity than copper (e.g. aluminum or an aluminum alloy) may be used as the conductor 41.

The housing 10 is made e.g. of synthetic resin and long narrow cavities 11 are arranged side by side in the housing and extend in forward and backward directions FBD through the housing 10. The rear end of the cavity 11 defines a terminal insertion opening in the rear end of the housing 10. A locking lance 12 is cantilevered forward along a bottom wall of each cavity 11. Each locking lance 12 is resiliently deformable up and down in directions intersecting an inserting direction of the terminal fitting 20 into the cavity 11. A locking projection 13 is formed on the upper surface of each locking lance 12 for locking the terminal fitting 20.

A mount space 14 is formed in the housing 10 and opens in the upper surface of the housing 10 substantially opposite to the wall where the locking lance 12 is provided. The mount space 14 penetrates the respective ceiling surfaces of the cavities 11 to communicate with the cavities 11. A formation area of the mount space in forward and backward directions extends from the rear ends of terminal connecting portions 21 of the terminal fittings 20 properly inserted in the cavities 11 to the front ends of insulation barrels 26.

Each terminal fitting 20 is a female terminal fitting formed by bending, folding and/or embossing a conductive (preferably metal) plate material punched or cut out into a specified shape. A terminal connecting portion 21 is defined adjacent a front end of each terminal fitting 20 and is configured to connect with a long narrow tab (not shown) of a male mating terminal. A locking hole or recess (not shown) is formed in a lower plate of the terminal connecting portion 21 and is engageable with the locking projection 13 of the locking lance 12.

A coupling 22 is connected with the rear end of the terminal connecting portion 21. The coupling portion 22 includes a bottom plate continuous with the lower plate of the terminal connecting portion 21 and two side plates that project up substantially right angles from the opposite left and right sides of the bottom plate. The top edges of the side plates are below the upper surface of the terminal connecting portion 21. A receiving portion 23 is formed at the rear end of the terminal connecting portion 21 above the top edges of the side plates of the coupling 22. The retainer 30 is engageable with the receiving portion 23 at the boundary between the terminal connecting portion 21 and the coupling 22.

The terminal fitting 20 is inserted into the cavity 11 from behind. As a result, the lower plate of the terminal connecting portion 21 contacts the locking projection 13 and deforms the locking lance 12 resiliently down in a direction intersecting the inserting direction of the terminal fitting 20 into the cavity 11. The locking lance 12 resiliently restores upwardly when the terminal fitting 20 is inserted to a proper position so that the locking projection 13 fits into the locking hole and retains the terminal fitting 20. The wire 40 particularly is drawn out backward from the rear surface of the housing 10 when the terminal fitting 20 is inserted properly.

A wire crimping portion 24 in the form of an open barrel is formed in a rear end region of the terminal fitting 20. The wire crimping portion 24 includes a wire barrel 25 and an insulation barrel 26 behind the wire barrel 25. The front end of the wire barrel 25 is unitary with the rear end of the coupling 22.

The wire barrel 25 has a bottom wall 25A that is continuous with the bottom plate of the coupling 22 and two crimping pieces 25B project up from opposite left and right sides of the bottom wall 25A. The crimping pieces 25B can be crimped, bent or folded into electrical connection with the conductor 41 of the wire 40. The crimping pieces 25B are deformed during a crimping operation and wound at least partly around the conductor 41 that has been placed on the bottom wall 25A of the wire barrel 25. A crimper of an unillustrated applicator crimps the entire areas of the crimping pieces 25B except front and rear ends during the crimping operation. Thus, large-diameter portions 25C called bell mouths are formed at the front and rear ends of the wire barrel 25. Upper ends of the large-diameter portions 25C of the wire barrel 25 are lower than the upper surface of the terminal connecting portion 21, but higher than the side plates of the coupling 22, when the wire barrel 25 is crimp-connected to conductor 41. Hence, front and rear ends of the wire barrel 25 have a larger projecting distance from the bottom wall 25A than an intermediate portion of the wire barrel 25 along the forward and backward directions FBD.

The insulation barrel 26 has a bottom wall 26A continuous with the bottom wall 25A of the wire barrel 25 and two crimping pieces 26B that stand up from left and right sides of the bottom wall 26A. The insulation barrel 26 is crimped, bent or folded into connection with a part of the wire 40 covered by the insulation coating 42 similar to the wire barrel 25. In a crimped state, the upper end of the insulation barrel 26 is higher than the upper end of the wire barrel 25 and lower than the upper surface of the terminal connecting portion 21.

The retainer 30 is made e.g. of synthetic resin, and is assembled into the housing 10 by being inserted in a mounting direction MD as if by being dropped from above. A locking portion 31 is defined at a lower edge of the front surface of the retainer 30 and is engageable from behind with the receiving portions 23 of the terminal fittings 20 and along a draw-out direction DOD. Resilient pressing portions 32 are formed on the lower surface of the retainer 30 and can be inserted into the mount space 14 to face the wire barrels 25 of the terminal fittings 20 that have been inserted in the cavities 11. The resilient pressing portions 32 are narrow and long in forward and backward directions and are formed substantially side by side to correspond to the respective cavities 11. Each resilient pressing portion 32 has front and rear ends supported on the retainer 30 and are resiliently deformable to be curved vertically along the mounting direction MD of the retainer 30 into the housing 10. Deformation spaces 33 are formed above the resilient pressing portions 32 for permitting upward deformations of the resilient pressing portions 32.

The retainer 30 can be held in the mount space 14 at a full locking or mounted position MP, as shown in FIG. 1, or at a partial locking or standby position SP, as shown in FIG. 2 by unillustrated known locking means. Additionally, the retainer 30 can be moved between these two positions MP, SP along the mounting direction MD and substantially orthogonal to the inserting direction of the terminal fittings 20.

The retainer 30 is held at the partial locking position SP when inserting the terminal fittings 20 into the cavities 11. At this time, the resilient pressing portions 32 the retainer 30 is retracted from insertion paths of the terminal fittings 20 into the cavities 11. More particularly, the resilient pressing portions 32 at the lower surface of the retainer 30 are at the same height as the ceiling surfaces of the cavities 11 and do not hinder insertion of the terminal fittings 20. The retainer 30 is pushed in the mounting direction MD to the full locking position MP after the terminal fittings 20 are inserted properly. Thus, the locking portion 31 and the resilient pressing portions 32 of the retainer 30 enter the cavities 11 and into the insertion paths of the terminal fittings 20 into the cavities 11. The locking portion 31 engages the receiving portions 23 to retain the terminal fittings 20 in the cavities 11. In other words, the terminal fittings 20 are locked doubly by the locking lances 12 and the retainer 30 to be held reliably in the cavities 11.

The lower surfaces of the resilient pressing portions 32 contact the wire barrel 25 from above and in the mounsing direction MD when the retainer 30 is moved to the full locking mounted position MD. At this time, the resilient pressing portions 32 resiliently press the wire barrels 25 from above so that the terminal fittings 20 are pressed against the bottom walls of the cavities 11 to prevent upward displacements of the terminal fittings 20. Accordingly, pressing forces of the resilient pressing portions 32 prevent posture changes of the terminal fittings 20 even if an external force acts on the wires 40 drawn out backward from the housing 10 in a direction intersecting with the draw-out direction DOD from the housing 10.

A formation region of the resilient pressing portions 32 in forward and backward directions FBD extends from a position before the front end of the wire barrel 25 to a position behind the rear end of the wire barrel 25, and the lower surfaces of the resilient pressing portions 32 press the wire barrels 25 at the large-diameter portions 25C at the front and/or rear ends. A distance between these two pressing positions is substantially equal to the entire length of the wire barrel 25 to define a maximum pressing range for the wire barrel 25 in forward and backward directions FBD. Thus, backward and forward inclining postures of the terminal fittings 20 are prevented reliably.

The dimension of the crimped wire barrels 25 may vary in the vertical pressing direction of the resilient pressing portions 32 due to springback after the crimping operation. However, the resilient pressing portions 32 resiliently press the wire barrels 25 even if the dimension of the wire barrels 25 varies. Thus, such a variation can be absorbed and pressing forces can be given reliably to the wire barrels 25.

The extend in a direction substantially parallel to a length direction of the wires 40 and the front and rear ends of the resilient pressing portions 32 are supported on the retainer 30. Thus, strong resilient pressing forces can be exhibited as compared with cantilevered pressing portions.

The invention is not limited to the above described and illustrated embodiment. For example, the following embodiments are also included in the technical scope of the present invention.

Although the front and rear ends of the resilient pressing portions are supported on the retainer in the above embodiment, the resilient pressing portions may have only the front or rear end supported on the retainer.

The retainer resiliently presses only the wire barrels in the above embodiment. However, the retainer may also give a resilient pressing force to the insulation barrels.

The retainer is assembled into the housing as a separate component in the above embodiment. However, the retainer may be formed integral or unitary to the housing via at least one hinge.

The retainer 30 can be held at either the partial locking position or the full locking position in the above embodiment. However, the retainer may be held only at the full locking position without being held at the partial locking position.

Although the resilient pressing portions press the front and rear ends of the wire barrels in the above embodiment, they may press the wire barrel portions at positions behind the front ends of the wire barrels or at positions before the rear ends of the wire barrels.

A female terminal fitting with a rectangular tubular terminal connecting portion is described in the above embodiment. However, the invention also is applicable to a male terminal fitting including a terminal connecting portion in the form of a long narrow tab projecting forward from the front end of a rectangular tube portion.

What is claimed is:

1. A connector, comprising:

a housing formed with at least one cavity and at least one locking lance;

at least one terminal fitting insertable into the cavity, the terminal fitting having a terminal connecting portion at a front end and configured for connection with a mating terminal, the terminal connecting portion being engageable with the locking lance, at least one wire connection portion behind the terminal connecting portion;

a wire having a conductor electrically connected with the wire connection portion and drawn out in a draw-out direction from the housing; and a retainer being formed with at least one locking portion for preventing a displacement of the terminal fitting out of the housing by being engaged with the terminal connecting portion from a withdrawal side, the retainer further being formed with at least one resilient pressing portion having opposite ends supported on the retainer and being configured for resiliently pressing the wire connection portion in a direction intersecting with the draw-out direction of the wire from the housing, whereby the resilient pressing portion prevents the terminal fitting from inclining in response to forces on the wire.

2. The connector of claim 1, wherein the wire connection portion comprises at least one wire barrel crimp-connected with the conductor of the wire.

3. The connector of claim 2, wherein the resilient pressing portion extends in a direction substantially parallel to a length direction of the wire and has the front and rear ends thereof supported on the retainer.

4. The connector of claim 2, wherein the resilient pressing portion presses at least the front and rear ends of the wire barrel.

5. The connector of claim 4, wherein a longitudinal extension of the resilient pressing portion is set such that a distance between pressing positions of the resilient pressing portion on the wire barrel is substantially equal to an entire length of the wire barrel to define a maximum pressing range for the wire barrel in forward and backward directions.

6. The connector of claim 4, wherein the resilient pressing portion extends in forward and backward directions from a position before the front end of the wire barrel to a position behind the rear end of the wire barrel.

7. The connector of claim 2, wherein large-diameter portions are formed at the front and rear ends of the wire barrel.

8. The connector of claim 1, wherein a mount space is formed in the housing to open in a surface of the housing substantially opposite to the locking lance, the retainer the retainer being mountable into the mount space to engage the terminal fitting.

9. The connector of claim 1, wherein the housing comprises a plurality of cavities for arranging a plurality of the terminal fittings therein and the retainer comprises a plurality of resilient pressing portions corresponding respectively to the cavities.

10. A connector, comprising:

a housing having opposite front and rear ends and at least one cavity extending through the housing from the rear end to the front end, the cavity being defined partly by a bottom wall in proximity to the rear end of the housing and a locking lance cantilevered forward from the bottom wall;

at least one terminal fitting insertable in the cavity, a terminal connecting portion at a front end of the terminal fitting and configured for connection with a mating terminal, the terminal connecting portion being engageable with the locking lance, at least one wire connection portion behind the terminal connecting portion;

a wire having a conductor electrically connected with the wire connection portion; and a retainer engaged with the terminal connecting portion from a withdrawal side for preventing a displacement of the terminal fitting out of the housing, the retainer being formed with at least one resilient pressing portion resiliently pressing the wire connection portion against the bottom wall of the housing in a direction intersecting the draw-out direction of the wire from the housing for preventing the terminal fitting from inclining in response to forces on the wire.

11. The connector of claim 10, wherein the wire connection portion comprises at least one wire barrel crimp-connected with the conductor of the wire.

12. The connector of claim 11, wherein the resilient pressing portion extends in a direction substantially parallel to a length direction of the wire and has the front and rear ends thereof supported on the retainer.

13. The connector of claim 11, wherein the resilient pressing portion presses at least the front and rear ends of the wire barrel.

14. The connector of claim 13, wherein a longitudinal extension of the resilient pressing portion is set such that a distance between pressing positions of the resilient pressing portion on the wire barrel is substantially equal to an entire length of the wire barrel to define a maximum pressing range for the wire barrel in forward and backward directions.

15. The connector of claim 13, wherein the resilient pressing portion extends in forward and backward directions from a position before the front end of the wire barrel to a position behind the rear end of the wire barrel.

16. The connector of claim 10, wherein the housing comprises a plurality of cavities for arranging a plurality of the terminal fittings therein and the retainer comprises a plurality of resilient pressing portions corresponding respectively to the cavities.

* * * * *